US006557665B2

(12) United States Patent
McWilliam et al.

(10) Patent No.: US 6,557,665 B2
(45) Date of Patent: May 6, 2003

(54) ACTIVE DIPOLE INLET USING DRONE CONE SPEAKER DRIVER

(75) Inventors: Richard D. McWilliam, Shedden (CA); Ian R. McLean, Chatham (CA)

(73) Assignee: Siemens Canada Limited, Ontario (CA)

( * ) Notice: Subject to any disclaimer, the term of this patent is extended or adjusted under 35 U.S.C. 154(b) by 13 days.

(21) Appl. No.: 09/858,414

(22) Filed: May 16, 2001

(65) Prior Publication Data

US 2001/0047903 A1 Dec. 6, 2001

Related U.S. Application Data

(60) Provisional application No. 60/209,753, filed on Jun. 6, 2000.

(51) Int. Cl.[7] ..... F01N 1/06

(52) U.S. Cl. ..... 181/206; 381/71.1

(58) Field of Search ..... 181/206, 224, 181/229; 381/71.5, 71.7, 71.1; 137/13, 828, 833

(56) References Cited

U.S. PATENT DOCUMENTS

| | | | | |
|---|---|---|---|---|
| 3,936,606 A | | 2/1976 | Wanke | |
| 4,410,065 A | | 10/1983 | Harvey | |
| 4,665,549 A | | 5/1987 | Eriksson et al. | |
| 4,876,722 A | | 10/1989 | Dekker et al. | |
| 4,947,434 A | | 8/1990 | Ito | |
| 5,170,019 A | | 12/1992 | Lee | |
| 5,229,556 A | | 7/1993 | Geddes | |
| 5,319,165 A | | 6/1994 | Geddes | |
| 5,336,856 A | | 8/1994 | Krider et al. | |
| 5,426,703 A | | 6/1995 | Hamabe et al. | |
| 5,426,705 A | | 6/1995 | Yokota et al. | |
| 5,432,857 A | | 7/1995 | Geddes | |
| 5,446,249 A | | 8/1995 | Goodman et al. | |
| 5,446,790 A | | 8/1995 | Tanaka et al. | |
| 5,457,749 A | | 10/1995 | Cain et al. | |
| 5,466,899 A | | 11/1995 | Geisenberger | |
| 5,513,266 A | | 4/1996 | Zuroski | |
| 5,541,373 A | | 7/1996 | Cheng | |
| 5,550,334 A | | 8/1996 | Langley | |
| 5,587,563 A | | 12/1996 | Yazici et al. | |
| 5,693,918 A | | 12/1997 | Bremigan et al. | |
| 5,797,414 A | * | 8/1998 | Sirovich et al. | 137/13 |
| 5,828,759 A | | 10/1998 | Everingham | |
| 6,084,971 A | | 7/2000 | McLean | |

FOREIGN PATENT DOCUMENTS

| | | |
|---|---|---|
| EP | 0 884 471 A3 | 7/1999 |

* cited by examiner

*Primary Examiner*—Khanh Dang

(57) ABSTRACT

An air induction system comprises an air induction body, a speaker with a first diaphragm disposed about the air induction body, and a second diaphragm spaced from the first diaphragm. A signal is generated from the first diaphragm and transmitted to the second diaphragm. The second diaphragm generates a noise attenuating sound.

20 Claims, 1 Drawing Sheet

ACTIVE DIPOLE INLET USING DRONE CONE SPEAKER DRIVER

This application claims priority to Provisional Patent Application Ser. No. 60/209,753 filed Jun. 6, 2000.

BACKGROUND OF THE INVENTION

This invention relates to an active control of automotive induction noise.

Manufacturers have employed active and passive methods to reduce engine noise within the passenger compartment of motor vehicles. Such noise frequently emanates from the engine, travels through the air induction system and emanates out of the mouth of the air intake into the passenger compartment. Efforts have been made to reduce the amount of engine noise traveling through the air induction system. These efforts include the use of both passive devices such as expansion chambers and Helmholtz resonators and active devices involving anti-noise generators.

Active noise attenuation systems use a speaker to create a sound that attenuates engine noise. The sound created is out of phase with the engine noise and combines with the engine noise to result in its reduction. Generally, this sound is generated in proximity to the air induction system. In one such system, the speaker is placed in the mouth of air intake duct.

At low sound frequencies, speakers of current active noise attenuation systems may experience a significant reduction of speaker response. As a consequence, current active noise attenuation systems reduce engine noise less than optimally at these frequencies. Undesirable engine sound may find its way back to the passenger compartment as a consequence.

A need therefore exists to improve speaker response of such systems at low sound frequencies without affecting the effectiveness of the speakers at higher frequencies.

SUMMARY OF THE INVENTION

In a disclosed embodiment of this invention, an air induction system comprises an air induction body, a speaker with a first diaphragm disposed about the air induction body, and a second diaphragm spaced from the first diaphragm. A signal, a sound wave, is generated from the first diaphragm and transmitted to the second diaphragm. The second diaphragm generates a noise attenuating sound.

A flow body may interconnect the first diaphragm to the second diaphragm. A tube may be used as the flow body. Further, seals may interconnect the flow body to the first and second diaphragms, creating an inductive mass. This inductive mass serves to improve speaker response at low frequency ranges. While the first diaphragm may be disposed in the air induction body, the second diaphragm may be placed about the mouth of the body. The second diaphragm is preferably flexible. An air filter may also be disposed with the air induction body.

In communication with the speaker is a control unit, which serves to control noise attenuation by the invention. The control unit generates a signal for the speaker with the first diaphragm. The signal is then transmitted to the second diaphragm spaced from the first diaphragm. The signal may be transmitted through a flow body. From the second diaphragm, a noise attenuating sound is created to limit engine noise.

In this way, the invention improves speaker response for noise attenuation systems at a low frequency range without sacrificing speaker response at higher frequencies. Noise attenuation systems are thereby better able to respond to engine noises of low frequency. The improved response is afforded without significant alteration to existing noise attenuation systems. Indeed, the system is easily implemented into existing air induction systems without much additional expense, cost, or labor to install.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
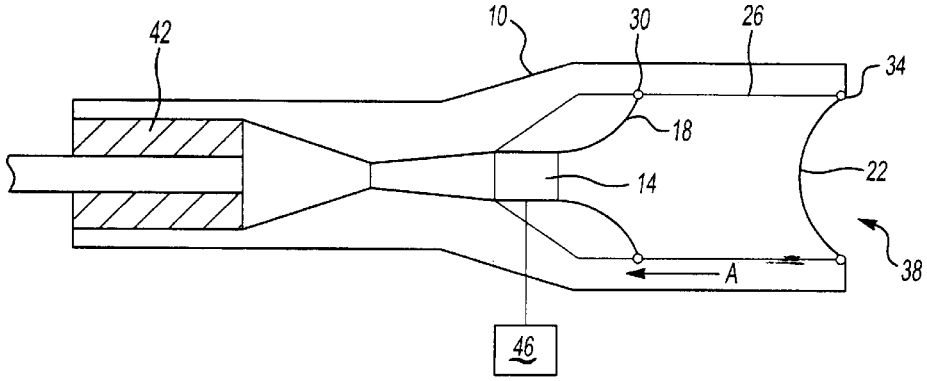
FIG. 1 shows an embodiment of the invention.

FIG. 1 shows an embodiment of the invention. The air induction system comprises air induction body 10, speaker 14 with first diaphragm 18, and second diaphragm 22, which is spaced from first diaphragm 18. As can bee seen from the drawing, speaker 14 and first diaphragm 18 are disposed about air induction body 10. While first diaphragm 18 may be of a design well known, second diaphragm 22 is preferably flexible.

The air induction system may include flow body 26 interconnecting first diaphragm 18 and second diaphragm 22. Here, the flow body is a tube, although one skilled in the art may employ other forms to perform the same function of creating an inductive mass. Seal 30 and seal 34 may serve to interconnect flow body 26 to first diaphragm 18 and second diaphragm 22, respectively. Mouth 38, an opening as known in the art, may be part of air induction body 10. It is preferable that second diaphragm 22 be disposed about mouth 38 as pictured. Additionally, air filter 42 may also be disposed in air induction body 10 to filter incoming air in the direction of arrow A, which is in the direction of the vehicle engine.

Control unit 46, as known in the art, may be in communication with speaker 14 to thereby control sound output to attenuate engine noise. In this configuration, control unit 46 may generate a signal through speaker 14 and first diaphragm 18. The signal is transmitted to second diaphragm 22. The signal may be transmitted through a sealed flow body such as a tube. In response to this signal, second diaphragm 22 generates a noise attenuating sound, which, as known, is generally out of phase with engine noise to thereby cancel sound. The signal is thus transmitted through an inductive mass, which improves speaker response at low frequency ranges.

Figure 2:
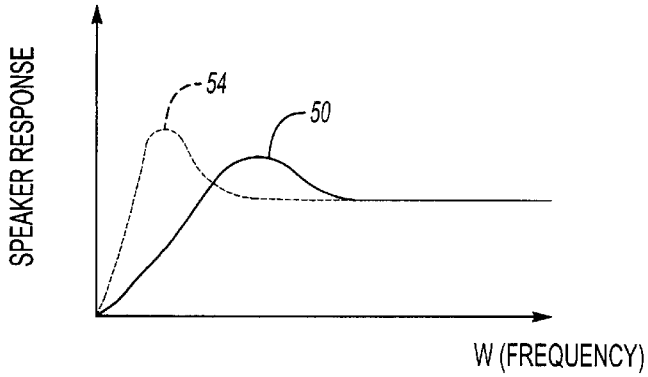
FIG. 2 shows a graph of the improved acoustic response afforded by the invention.

FIG. 2 illustrates the benefit of the system. Speaker response is shown over sound frequency. Line 50 illustrates speaker response of prior art systems over a wide frequency range. As shown, speaker response deteriorates at low sound frequencies. With the device of FIG. 1, as shown by line 54 (dashed lines), speaker response improves to permit noise attenuation at low frequency ranges without sacrificing speaker response at higher frequency ranges.

Figure 3:
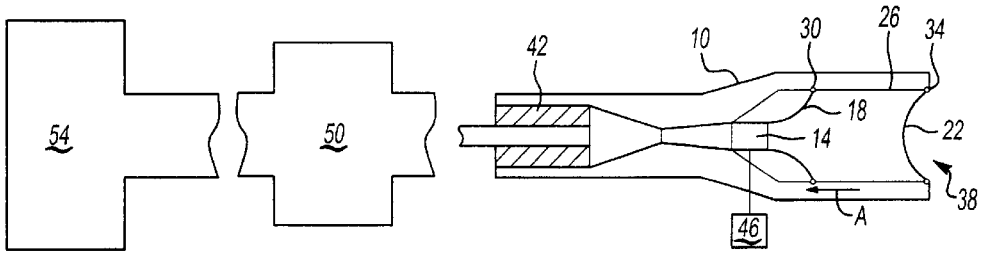
FIG. 3 shows the embodiment of FIG. 1 in relation to a vehicle throttle body and engine.

FIG. 3 shows the system in relation to vehicle throttle body 50 and vehicle engine 54. Throttle body 50 and vehicle engine 54 are both shown schematically. The system may be connected to throttle body 50 by means known in the art.

The aforementioned description is exemplary rather then limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. An air induction system comprising:

an air induction body;

a speaker, and a first acoustic diaphragm disposed about said speaker within said air induction body, in communication with said speaker; and a second acoustic diaphragm spaced from said first acoustic diaphragm, said second acoustic diaphragm acoustically receptive to said first acoustic diaphragm and generating noise attenuating sound.

2. The air induction system of claim 1 further including a flow body interconnecting said first acoustic diaphragm and said second acoustic diaphragm.

3. The air induction system of claim 2 wherein said flow body is a tube.

4. The air induction system of claim 2 further including at least one seal interconnecting said flow body to said first acoustic diaphragm.

5. The air induction system of claim 2 further including at least one seal interconnecting said flow body to said second acoustic diaphragm.

6. The air induction system of claim 1 further including a mouth operatively connected to said air induction body wherein said second acoustic diaphragm is disposed within said mouth.

7. The air induction system of claim 1 further including an air filter disposed in said air induction body.

8. The air induction system of claim 1 further including a control unit in communication with said speaker, controlling output to attenuate engine noise.

9. The air induction system of claim 1 wherein said second acoustic diaphragm is flexible.

10. An air induction system comprising:

an air induction body;

a speaker with a first acoustic diaphragm disposed within said air induction body, said first diaphragm in communication with said speaker;

a second acoustic diaphragm spaced from said first diaphragm and in acoustic communication with said first acoustic diaphragm; and a flow body interconnecting said first acoustic diaphragm and said second diaphragm, said second acoustic diaphragm generating a noise attenuating sound.

11. The air induction system of claim 10 wherein said flow body is a tube.

12. The air induction system of claim 11 further including at least one seal interconnecting said flow body to said first acoustic diaphragm.

13. The air induction system of claim 11 further including at least one seal interconnecting said flow body to said second acoustic diaphragm.

14. The air induction system of claim 10 further including a mouth operatively connected to said air induction body wherein said second acoustic diaphragm is disposed within said mouth.

15. The air induction system of claim 10 further including an air filter disposed in said air induction body.

16. The air induction system of claim 10 further including a control unit in communication with said speaker, controlling output to attenuate engine noise.

17. The air induction system of claim 10 wherein said second acoustic diaphragm is flexible.

18. A method of noise attenuation comprising the steps of:

generating an acoustic sound from a first acoustic diaphragm in an air induction body;

transmitting the acoustic sound to a second acoustic diaphragm; and generating a noise attenuating sound from the second diaphragm based on the received acoustic sound.

19. The method of claim 18 wherein the signal is transmitted through a flow body.

20. The method of claim 19 wherein the flow body is sealed.

* * * * *